US010414607B2

(12) United States Patent
Wick

(10) Patent No.: US 10,414,607 B2
(45) Date of Patent: Sep. 17, 2019

(54) PORTIONING SYSTEM FOR PORTIONING STACKABLE FLAT ELEMENTS IN A STACK FOR A FURTHER PROCESSING

(71) Applicant: BOBST GRENCHEN AG, Grenchen (CH)

(72) Inventor: Stefan Wick, Oberbuchsiten (CH)

(73) Assignee: BOBST GRENCHEN AG (CH)

( * ) Notice: Subject to any disclaimer, the term of this patent is extended or adjusted under 35 U.S.C. 154(b) by 0 days.

(21) Appl. No.: 15/536,691

(22) PCT Filed: Dec. 17, 2015

(86) PCT No.: PCT/EP2015/025108

§ 371 (c)(1),
(2) Date: Jun. 16, 2017

(87) PCT Pub. No.: WO2016/096158

PCT Pub. Date: Jun. 23, 2016

(65) Prior Publication Data

US 2017/0349391 A1 Dec. 7, 2017

(30) Foreign Application Priority Data

Dec. 18, 2014 (EP) ..... 14020114

(51) Int. Cl.
*B65H 3/24* (2006.01)
*B65H 3/32* (2006.01)
(Continued)

(52) U.S. Cl.
CPC ..... *B65H 3/242* (2013.01); *B65H 3/322* (2013.01); *B65H 5/006* (2013.01); *B65H 5/08* (2013.01);
(Continued)

(58) Field of Classification Search
CPC ..... B65H 3/242; B65H 5/08; B65H 5/006; B65H 2701/1762; B65H 2301/42242; B65H 2404/733; B65H 2301/42266
(Continued)

(56) References Cited

U.S. PATENT DOCUMENTS 3,837,505 A * 9/1974 Muggli ..... B65H 29/001 414/790.3
4,457,658 A * 7/1984 Meylan ..... B65H 3/242 414/795.8
(Continued)

FOREIGN PATENT DOCUMENTS

CN 204538064 * 8/2015 ..... H01L 31/18
DE 41 24 077 A1 1/1993
(Continued)

OTHER PUBLICATIONS

International Search Report dated Feb. 19, 2016 in corresponding PCT International Application No. PCT/EP2015/025108.
(Continued)

*Primary Examiner* — Lynn E Schwenning
(74) *Attorney, Agent, or Firm* — Ostrolenk Faber LLP

(57) ABSTRACT

A portioning system for portioning stackable flat carton elements in a stack (101) for further processing. A feeder device (105) includes a lifting platform (106) and a pushing platform (107), wherein the feeder device (105) is movable along a linear path (108) for pushing the stack (101) to a delivery position. The feeder device (105) is further movable along a lifting direction (110) having at least a component parallel to the gravity direction. The feeder device (105) is configured such that the lifting platform (106) is movable partially below the flat elements defining the stack (101) such that an edge portion (111) of the stack (101) is arranged on the lifting platform (106) for being liftable by the lifting platform (106). The feeder device (105) is further configured
(Continued)

such that the stack (101) is pushable by the pushing platform (107) along the linear path (108) until the stack (101) is arranged at the delivery position.

12 Claims, 5 Drawing Sheets

(51) Int. Cl.
*B65H 5/00* (2006.01)
*B65H 5/08* (2006.01)

(52) U.S. Cl.
CPC ..... *B65H 2301/42242* (2013.01); *B65H 2301/42266* (2013.01); *B65H 2404/733* (2013.01); *B65H 2701/1762* (2013.01)

(58) Field of Classification Search
USPC ..... 414/796
See application file for complete search history.

(56) References Cited

U.S. PATENT DOCUMENTS 4,921,398 A * 5/1990 Fluck ..... B65D 23/14 198/464.2
5,044,874 A * 9/1991 Shill ..... B65G 59/026 414/796
5,169,284 A * 12/1992 Berger ..... B65G 47/907 414/796.9
5,205,703 A * 4/1993 Shill ..... B65H 3/322 414/796
5,380,147 A * 1/1995 Hess ..... B65G 61/00 414/796
5,692,878 A * 12/1997 Freund ..... B65G 59/026 414/796.6
5,913,655 A * 6/1999 Maday ..... B65G 59/02 198/592
5,924,839 A * 7/1999 Dopke ..... B65G 59/02 414/796
6,595,740 B1 * 7/2003 Drake ..... B65H 1/00 271/157
6,746,203 B2 * 6/2004 Leblanc ..... B65G 59/005 294/907
2003/0056471 A1 * 3/2003 Linker, II ..... H01L 21/67778 53/445
2008/0308997 A1 * 12/2008 Gleason ..... B65H 5/10 271/10.01

FOREIGN PATENT DOCUMENTS

DE 295 02 308 U1 6/1996
EP 1 505 018 A1 2/2005
JP H0569970 * 3/1993 ..... B65H 3/32
JP H05-254678 A 10/1993

OTHER PUBLICATIONS

Written Opinion dated Feb. 19, 2016 in corresponding PCT International Application No. PCT/EP2015/025108.

* cited by examiner

PORTIONING SYSTEM FOR PORTIONING STACKABLE FLAT ELEMENTS IN A STACK FOR A FURTHER PROCESSING

CROSS-REFERENCE TO RELATED APPLICATIONS

The present application is a 35 U.S.C. §§ 371 national phase conversion of PCT/EP2015/025108, filed Dec. 17, 2015, which claims priority of European Patent Application No. 14020114.6, filed Dec. 18, 2014, the contents of which are incorporated by reference herein. The PCT International Application was published in the English language.

FIELD OF INVENTION

The present invention relates to a portioning system and a method for portioning stackable flat elements, in particular carton elements, in a stack for a further processing.

Moreover, a handling system comprising the portioning system, a transfer system for transferring the stack to a processing device and a feeder system for feeding the stack to the processing device is presented.

BACKGROUND OF THE INVENTION

In the processing industry, raw material, such as flat carton elements, is delivered in large units. The large units of the carton elements have to be converted into stacks comprising a predefined number of the carton elements before the carton elements can be further processed in a processing unit, such as a printing machine for printing desired designs on the carton elements.

In conventional printing machines, it is not possible to feed the carton elements from delivered large units, because the height of the large units is too tall for feeder systems which feed the respective carton element to the printing machine. Today, the large units of carton elements have to be converted into stacks comprising a desired amount of cartons by providing expensive robot arms or by manually controlled cranes, for example. However, the multiple carton elements in a stack cause a large weight of the stack which is not easy to handle by the conventional cranes and carrying systems.

SUMMARY OF THE INVENTION

It is an object of the present invention to provide a system for transferring stackable flat elements in a stack having a desired amount of flat elements.

This object is solved by a positioning system and a method for portioning stackable flat elements, in particular carton elements, and by a handling system according to the disclosure herein.

According to a first aspect of the present invention, a portioning system for portioning stackable flat elements, in particular carton elements, in a stack for a further processing is presented. The portioning system comprises a stacking section on which flat elements are stackable. A delivery position (e.g. a delivery ramp as described below) is arranged adjacent to the stacking section such that the stack is pushable from the stacking section to the delivery position.

The system further comprises a feeder device comprising a lifting platform and a pushing platform. The feeder device is movable along a predefining linear path for pushing the stack to the delivery position (e.g. the delivery ramp as described below). The feeder device is further movable along a lifting direction having at least a component which is parallel to the direction of the force of gravity. The feeder device is configured such that the lifting platform is movable to be partially below the flat elements defining the stack, such that an edge portion of the stack is arranged on the lifting platform for being liftable by the lifting platform. The feeder device is further configured such that the stack is pushable by the pushing platform along the linear path until the stack is arranged at the delivery position (e.g. on a delivery ramp as described below). The portioning system further comprises a further pushing platform which is movable along the linear path. The further pushing platform is configured for being moved against a lateral face of the stack such that the stack is pushed along the linear path in the direction to the feeder device such that the edge portion of the stack is arrangeable on the lifting platform.

According to a further aspect of the present invention, a method for portioning stackable flat elements, in particular carton elements, in a stack for a further processing is described. According to the method, flat elements are stacked on a stacking section. A lifting platform of a feeder device is moved partially below the flat elements defining the stack such that an edge portion of the stack is arranged on the lifting platform. The lifting platform is moved along a lifting direction having at least a component being parallel to the direction of the force of gravity. The stack is pushed by a pushing platform of the feeder device along a linear path until the stack is arranged at the delivery position (e.g. arranged on a delivery ramp as described below). Before the step of moving the lifting platform of the feeder device partially below the flat elements defining the stack, a further pushing platform is moved along the linear path and against a lateral face of the stack such that the stack is pushed along the linear path in a direction to the feeder device such that the edge portion of the stack is arrangeable on the lifting platform.

The flat elements as described are in general elements which are stackable and each has a larger width and length than its thickness. The stackable flat elements may include elements which can be stacked on each other without any fixing means, such as screw connections or clamping connections. The flat elements denote elements which are stacked on each other, such that the resulting stack can be statically robust such that the stack does not need any holding system for preventing tilting of the stack. More specifically, the flat elements may comprise a thickness which is less than 10 cm and a length and width of more than 10 cm. Specifically, in a preferred embodiment, the flat elements are non-folded cartons. However, also other flat elements, such as sheet elements or other plate like elements can be portioned by the above described portioning system according to the present invention.

The stackable flat elements may be carton elements, such as corrugated card board. The carton elements may be made of paper, cardboard, or the other, flexible materials, such as sheets made of metal or plastic. The carton elements may be used for forming wrappers and packages.

The processing device may be a device for processing, laminating, coating or printing of the flat elements.

In the present description, an edge portion of the stack denotes a portion of the stack between an edge and a center portion of the stack within a plane along which the length and the width of the stack are defined. The edge portion runs along an edge of the stack and may have an area, within the plane, of ⅓ to 1/10 times or less than the area of a center portion of the stack. The center portion of a stack is surrounded by edge portions running along respective edges of the stack, wherein the edge portions define areas between the center portion and the respective edges of a stack.

The stacking section comprises for example an area, on which the flat elements are placed and hence stacked. For example, the flat elements arrive from the manufacturing side and are arranged on a palette (i.e. a Europalette). The flat elements are stacked onto such a palette to form a large tower which may be of a height of 2 meters or more. Such large towers of flat elements cannot be fed to further processing devices, because the feeding area of such processing devices may not handle such large towers of flat elements. As described in the following, this large tower of flat elements may be portioned by the portioning system according to the present invention into a stack which can be used for the further processing.

According to an exemplary embodiment of the present invention, the portioning system comprises a delivery ramp comprising a receiving surface forming the delivery position for receiving the stack. The delivery ramp is arranged adjacent to the stacking section in such a way that the stack is pushable from the stacking section to the delivery ramp.

The receiving surface of the delivery ramp is arranged and formed for receiving the stack which is separated from a lower stack of the flat elements which within the stacking section. The receiving surface has a predetermined height and forms a plateau, which has a similar height from the ground or a slightly lower height than the bottom of the stack. The bottom of the stack is formed by the lowermost flat element of the stack. In particular, the height of the receiving surface is slightly lower than the bottom of the stack, if the stack is still arranged within the stacking section, but is slightly higher than the height of the topmost flat element of the lower stack which rests within the stacking section. Hence, the stack may be simply pushed along a horizontal direction (i.e. the linear path) from the stacking section on the receiving surface, because the height of the receiving surface and the height of the bottom of the stack is almost similar.

After its portioning from the lower stack, which rests in the stacking section, the portioned stack rests on the receiving surface and may be used for the further processing, for example to deliver the stack to a desired location at a processing unit, such as a printing machine.

The feeder device is configured for separating each stack from the then lower stack by lifting and pushing the stack from the stacking section to the delivery ramp. Specifically, the feeder device comprises a lifting platform which is configured for lifting the flat elements that define the stack. The lifting platform defines a platform which comprises a sufficiently large supporting surface on which at least the edge portion of the stack may be arranged. Hence, lifting of the lifting platform, lifts the edge portion of the stack such that at least the edge portion and also a part of an adjacent center section of the stack is lifted from the lower stack. A further edge portion of the stack which is located at an opposite side of the stack in comparison to the lifted edge portion is still arranged on the topmost flat element of the lower stack.

This has the technical effect that frictional contact between the lowermost flat element of the stack and the topmost flat element of the lower stack is reduced, making a sliding of the stack with respect to the lower stack easier. In particular, the lifting platform is formed and arranged generally within a horizontal plane, such that the weight of the stack may be transferred to the lifting platform.

Furthermore, the feeder device comprises the pushing platform which is configured for pushing the stack along a linear path from the stacking section to the receiving surface. The pushing platform defines a platform which is sufficiently large that the stack may be pushed along the linear path without damaging the flat elements of the stack. In particular, the pushing platform is formed generally within a vertical plane such that a pushing force is exertable along a horizontal direction by moving the pushing platform along the linear path. In particular, the pushing platform is configured, such that the pushing platform may be guided against a lateral surface of the stack. In particular, the pushing platform is formed such that the pushing platform is pushing in particular against the lowermost flat element of the stack. However, the pushing platform may extend from the lowermost flat element of the stack to the topmost flat element of the stack such that a proper transfer of the pushing force to the stack is provided.

The lifting platform and the pushing platform may be moved relatively with respect to each other. According to a further exemplary embodiment of the present invention, the lifting platform and the pushing platform may be formed integrally and hence may be moved together such that no relative movement between the lifting platform and the pushing platform is possible.

The linear path defines a direction between the receiving surface and the stacking section along which the stack is movable. Furthermore, also the feeder device is movable specifically along the linear path.

The feeder device may be coupled to a feeder guiding system, for example a supporting framework. For example a guiding rail along the supporting framework arranged which extends along the linear path. The feeder device may be driven along the guiding rail automatically or manually in a remote controlled manner.

Hence, in the portioning system according to the present invention, the feeder device is driven in the lifting position, where the lifting platform is moved between a lowermost flat element of the stack and a topmost flat element of the lower stack to lift the stack from the lower stack. Next, the feeder device lifts the lifting platform along a lifting direction such that the edge portion and for example a further part of the center portion of the stack is lifted and hence separated from the topmost flat element of the lower stack. Next, the pushing platform of the feeder device pushes the stack from the lower stack at the stacking section above the receiving surface of the delivery ramp.

Hence, a robust portioning system for portioning a stack comprising a desired amount of flat elements is achieved, in a simple manner permitting a stack to be formed for further processing.

For example, the further pushing platform is moved against a lateral face of the further edge of the stack which is located opposite the edge where the lifting platform lifts the stack. The further pushing platform pushes the stack away from the delivery ramp such that the edge opposite the further edge extends from the lower stack along the linear path. Hence, it is easier to move the lifting platform below the edge portion because the edge portion extends from the lower stack. In other words, it is not necessary to move the lifting platform between the lowermost flat element of the stack and the topmost flat element of the lower stack. Hence, the lifting platform may be moved below the edge portion of the stack in a softer and smoother manner such that the risk of destroying a flat element is reduced.

The further pushing platform defines a platform which is sufficiently large such that the stack may be pushed along the linear path without damaging the flat elements of the stack. In particular, the further pushing platform is formed generally within a vertical plane such that a further pushing force is exertable along a horizontal direction away from the delivery ramp by moving the pushing platform along the linear path. In particular, the further pushing platform is formed such that the further pushing platform is pushing in particular against the lowermost flat element of the stack. However, the further pushing platform may extend from the lowermost flat element of the stack to the topmost flat element of the stack such that a proper transfer of the pushing force to the stack is provided.

According to an exemplary embodiment of the present invention, the feeder device is formed such that an angle between the lifting platform and the pushing platform is between 90° and 130°. For example, the lifting platform and the pushing platform may form a feeder which comprises an L-shaped cross section or profile.

According to an exemplary embodiment of the present invention, a position of the delivery ramp is adjustable along the vertical direction. Hence, the height of the delivery ramp from the bottom is adjustable. Hence, also the height of the receiving surface is adjustable in its height, so that the height and hence the amount of flat elements in the stack is adjustable by adjusting the height of the receiving surface. The higher the receiving section, the shorter is the height and the lower is the amount of flat elements of the stack is adjustable. The lower the receiving section, the taller is the height and the higher is the amount of flat elements of the stack is adjustable.

According to an exemplary embodiment of the present invention, the receiving surface is formed such that the stack is arrangeable on it by the feeder device, wherein (at least a section of) the receiving surface is formed within a plane which comprises a component parallel to the horizontal direction, such that the stack is slidable along the receiving surface by the force of gravity. In other words, the receiving surface or at least a part of the receiving surface is formed like a ramp having an inclination such that the stack slides due to gravity forces along the receiving surface to a desired final destination. Hence, no further pushing mechanism along the receiving surface may be necessary.

According to a further exemplary embodiment, to improve sliding of the stack along the receiving surface, a vibration system may be arranged for the receiving surface of the delivery ramp, such that the receiving surface vibrates. Vibrating the receiving surface, promotes sliding of the stack along the receiving surface.

According to a further exemplary embodiment of the present invention, the delivery ramp comprises a sliding rail arranged on the receiving surface. The stack is slideable along the sliding rail. The sliding rail is formed such that the stack is pushable on the sliding rail by the pushing platform. The sliding rail is a protrusion on the receiving surface. The sliding rail extends from an edge of the sliding surface adjacent to the stacking section along a direction to a section of the receiving surface which defines a desired final destination of the stack. By arranging the stack on the sliding rail, the contact region of the stack with respect to the receiving surface is reduced so that the friction between the stack and the receiving surface is reduced, promoting sliding of the stack along the receiving section.

According to a further exemplary embodiment of the present invention, the stacking section comprises a stacking platform on which the flat elements are stackable. The stacking platform is liftable along a vertical lifting direction.

Hence, the height of the stacking platform from the bottom is adjustable. Hence, also the height difference with respect to the receiving surface is adjustable, so that the height and hence the amount of flat elements in the stack is adjustable by adjusting the height of the stacking platform. The shorter is the height distance between the stacking platform and the receiving surface, the taller is the height of the stack to be portioned and the higher is the amount of flat elements of the stack. The taller is the height distance between the stacking platform and the receiving surface, the shorter is the height of the stack to be portioned and the lower is the amount of flat elements of the stack According to a further aspect of the present invention, a handling system for handling a stack of stackable flat elements, in particular carton elements, is presented. The handling system comprises the above described portioning system.

According to a further exemplary embodiment of the handling system, the handling system comprises a transfer system for transferring the stack to a processing device. The transfer system comprises a first comb structure comprising at least one first supporting platform on which at least the further edge portion of the stack is supportable, wherein the first comb structure is arranged at the delivery position (e.g. mounted to the delivery ramp). The transfer system further comprises a second comb structure comprising at least one second supporting platform on which at least the further edge portion of the stack is supportable, wherein the second comb structure is configured for supplying the stack to the processing device. The first supporting platform and the second supporting platform are arranged along a first direction one after another in an interleaved manner with the combs interleaved, such that the further edge portion is supportable on the first supporting platform and the second supporting platform. The first comb structure and the second comb structure are movable along the lifting direction with respect to each other such that the edge portion of the stack is supportable selectively by the first supporting platform or by the second supporting platform.

The first and the second supporting platforms are configured for supporting the flat elements defining the stack. Each of the first and the second supporting platform defines a platform which comprises a sufficiently large supporting surface, on which at least the further edge portion of the stack may be arranged.

The term "interleaved manner" denotes that the first supporting platform and the second supporting platform are arranged along the first (horizontal) direction one after another, wherein the first supporting platform and the second supporting platform comprise respective lateral edges which are arranged adjacent to each other along the first direction. The first direction describes for example a direction which is parallel to an edge of the delivery ramp and hence parallel to the further edge portion of the stack which is located on the delivery ramp.

According to a further exemplary embodiment of the present invention, the first comb structure comprises a first mounting bar extending along the first direction, wherein the at least one first supporting platform is mounted to the first mounting bar (which may be part of the delivery ramp) and extends from the mounting bar along a second direction, which is perpendicular to the first direction. The second comb structure comprises a second mounting bar extending along the first direction, wherein the second mounting bar is spaced apart from the first mounting bar along the second direction. The at least one second supporting platform is mounted to the second mounting bar and extends from the mounting bar along a third direction, which is not parallel to the second direction.

The first supporting platform is mounted to the delivery ramp. Hence, the edge of the stack located on the receiving surface may be supported by the first supporting platform. The second supporting platform may be mounted to a mounting structure, such as a mounting bar. The mounting structure and the delivery ramp may be arranged spaced apart from each other wherein the first supporting platform extends from the delivery ramp to the mounting structure and the second supporting platform extends from the mounting structure to the delivery ramp. Hence, the further edge portion of the stack is arranged in the gap between the mounting structure and the delivery ramp. Within the gap, the first supporting platform and the second supporting platform are arranged along the first direction, wherein dependent on the height of the delivery ramp for the mounting structure, the first or the second support porting platform supports the further edge portion.

The first supporting platform is movable (in particular along a vertical direction) with respect to the second supporting platform in such a way, that if the edge of the stack is supported by the first supporting platform, the second supporting platform may be moved against the further edge portion to lift the further edge portion of the stack away from the first supporting platform. Hence, the further edge portion of the stack is arranged on and supported by the second supporting platform. Alternatively, the first supporting platform may be lowered (i.e. along the vertical direction), e.g. by lowering the delivery ramp, such that the edge of the stack is supported by the second supporting platform if the first supporting platform is moved lower than the second supporting platform.

Hence, by the present invention, the stack is supported by the first system, i.e. the delivery ramp, and is transferred to a second system, e.g. the transfer system, in a robust and simple manner. If the further edge portion of the stack is supported by the second supporting platform, the second comb structure may be moved together with the stack to a further processing process, for example.

According to a further exemplary embodiment of the present invention, the first comb structure comprises at least two first supporting platforms on which the further edge portion of the stack is supportable. The two first supporting platforms are spaced along the first direction such that the second supporting platform is movable along the lifting direction through the space between the two first supporting platforms.

According to a further exemplary embodiment of the present invention, the second comb structure comprises at least two second supporting platforms on which the further edge portion of the stack is supportable. The two second supporting platforms are spaced along the first direction such that the first supporting platform is movable along the lifting direction through the space between the two second supporting platforms.

According to a further exemplary embodiment of the present invention, a feeder system is provided for feeding the stack to the processing device is described. The feeder system comprises a transport device comprising the at least one second supporting platform. The second supporting platform is arranged adjacent to the delivery position (e.g. the receiving surface) such that the further edge portion of the stack is receivable.

The feeder system further comprises a downholder element arranged for adjusting a size of a gap between the downholder element itself and the second supporting platform such that the further edge portion of the stack is clampable between the downholder element and the supporting platform. The transport device is configured to be movable between a receiving position and a hand over position at the processing device such that the stack is movable from the receiving position to the hand over position.

The downholder element may be a clamping bar extending along the further edge portion of the stack. Alternatively, the downholder element is a stamp which is formed to press a section of the further edge portion of the stack against the second supporting platform.

The above described transport system causes clamping of the further edge portion of the stack, by the downholder element to the second supporting platform. The rest of the stack, which is not clamped by the downholder element, is arranged on the receiving surface of the delivery ramp, for example. By moving the transport device along a desired moving direction, for example the first direction, the stack of flat elements slips away from the receiving surface to the desired location, such as the hand over position. Hence, by simply clamping a further edge portion of the stack, a simple and easy transport mechanism for the stack is achieved.

According to a further exemplary embodiment of the present invention, the transport device comprises a transport carriage to which the second supporting platform is coupled.

According to a further exemplary embodiment of the present invention, the transport carriage is coupled to a guiding rail such that the transport carriage is drivable along the guiding rail to the hand over position. The transport carriage may be coupled to the guiding rail, for example by a slide bearing or roller bearing.

According to a further exemplary embodiment of the present invention, a carrier element is arranged between the delivery position (e.g. the delivery ramp) and the hand over position, wherein the carrier element is further arranged such that a portion of the stack arranged at the delivery position (e.g. on the receiving surface) is receivable by the carrier element. The carrier element is configured to carry the portion of the stack between the delivery position (e.g. the delivery ramp) and the hand over position.

According to a further exemplary embodiment of the invention, the carrier element is fixed to a ground, wherein the carrier element comprises a sliding surface extending between the delivery ramp and the hand over position. The sliding surface is formed such that the stack is slideable on the sliding surface between the delivery ramp and the hand over position.

The carrier element is, for example, a table or a supporting bar which extends along a desired direction, in particular along the first direction. The carrier element is at the same height or slightly lower with respect to the receiving surface, such that the portion of the stack which surrounds the edge which is clamped by the downholder element may slip from the receiving surface on the carrier element. Hence, a smoother softer transport of the stack is provided.

According to a further exemplary embodiment, the transport system further comprises a carrier structure, wherein the carrier structure is fixed to the ground. The carrier structure is formed such that the carrier element is movable along the carrier structure between the delivery ramp and the hand over position. For example, the carrier element is coupled by a sliding bearing or a roller bearing to the carrier structure.

According to a further exemplary embodiment of the present invention, the handling system further comprises a hand over device which is arranged at the hand over position. The hand over device comprises a hand over platform, wherein the hand over platform is formed such that at the hand over position, the stack is feedable to the processing device. The hand over device comprises a further downholder element, wherein the further downholder element is arranged for adjusting a size of a further gap between the further downholder element itself and the hand over platform such that the edge portion of the stack is clampable between the further downholder element and the hand over platform.

If the second supporting platform is driven to the hand over position, the edge portion of the stack is arranged on the hand over platform. Next, the further downholder element clamps the edge against the hand over platform. In a next step, the downholder element may release the further edge portion of the stack and the transport device may drive back to the receiving position, where a new further stack may be received. Next, the further downholder element may release the edge portion of the stack and the flat elements forming the stack may be processed in the processing device.

According to a further exemplary embodiment of the present invention, the hand over device is movable such that a distance between the second supporting platform and the hand over platform is variable so that the hand over platform is movable away from the second supporting platform for pulling the further edge portion of the stack from the second supporting platform if the further downholder element clamps the edge portion to the hand over platform.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION OF EXEMPLARY EMBODIMENTS

Figure 1:
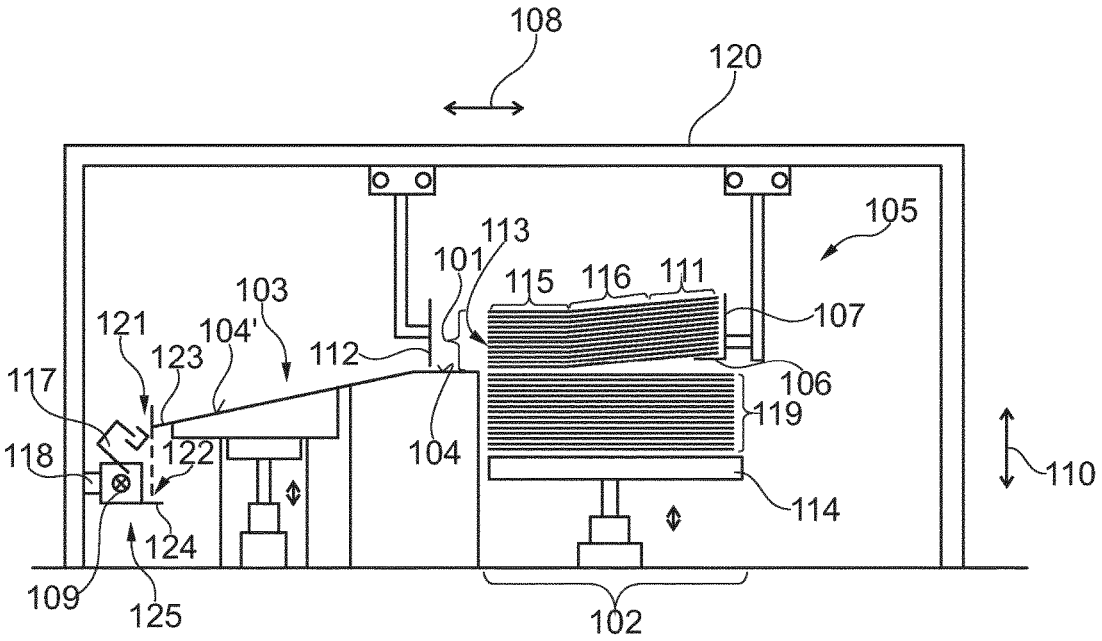
FIG. 1 to FIG. 6 show schematic views of a handling system comprising a portioning device, a transfer system and a feeder system according to exemplary embodiments of the present invention.

The illustrations in the drawings are schematic. In different Figures, similar or identical elements have the same reference signs.

FIG. 1 to FIG. 6 shows show a handling system comprising a portioning device, a transfer system and a feeder system according to exemplary embodiments of the present invention, in different operational states.

The portioning system is adapted for portioning carton elements in a stack 101 for further processing. The portioning system comprises a stacking section 102 on which flat elements are stackable and a delivery ramp 103 comprising a receiving surface 104 (e.g. forming a delivery position) for receiving the stack 101. The delivery ramp 103 is arranged adjacent to the stacking section 102 such that the stack 101 is pushable from the stacking section 102 to the delivery ramp 103.

The system further comprises a feeder device 105 comprising a lifting platform 106 and a pushing platform 107, wherein the feeder device 105 is movable along a linear path 108 for pushing the stack 101 to the delivery ramp 103. The feeder device 105 is further movable along a lifting direction 110 having at least a component parallel to the direction of the force of gravity. The feeder device 105 is configured such that the lifting platform 106 is movable partially below the flat elements defining the stack 101 such that the stack 101 is arranged on the lifting platform 106 for being liftable by the lifting platform 106. The feeder device 105 is further configured such that the stack 101 is pushable by the pushing platform 107 along the linear path 108 until the stack 101 is arranged on the delivery ramp 103.

The edge portion 111 of the stack 101 denotes a portion of the stack 101 which is in contact with the lifting platform 106. The edge portion 111 is between an edge and a center portion 116 of the stack 101 within a plane along which the length and the width of the stack 101 are defined. The further edge portion 115 of the stack 101 is defined between a further edge and a center portion 116, which further edge is an opposite further edge with respect to the edge along the linear path 108.

The stacking section 102 comprises, for example, an area on which the flat elements are placed and stacked. For example, the flat elements arrive from the manufacturing side and are arranged on a palette (i.e. a Europalette). Onto such a palette, the flat elements are stacked and form a large tower which may comprise a height of 2 meters or more.

The receiving surface 104 of the delivery ramp 103 is arranged and formed for receiving the stack 101 which is separated from a lower stack 119 of the flat elements which remain within the stacking section 102. The receiving surface 104 comprises a predetermined height and forms a plateau, which has a similar height from the ground or a slightly lower height than the bottom of the stack 101. The bottom of the stack 101 is formed by the lowermost flat element of the stack 101. In particular, the height of the receiving surface 104 is slightly lower than the bottom of the stack 101, if the stack 101 is still arranged within the stacking section 102, but is slightly higher than the height of the topmost flat element of the lower stack 119 which rests within the stacking section 102. Hence, the stack 101 may be simply pushed along a horizontal direction from the stacking section 102 on the receiving surface 104, because the height of the receiving surface 104 and the height of the bottom of the stack 101 are almost similar.

The stack 101 rests after the portioning from the lower stack 119, which rests in the stacking section 102, on the receiving surface 104 (see FIG. 5 and FIG. 6) and may be used for the further processing, for example to deliver the stack 101 to a desired location at a processing unit, such as a printing machine.

The feeder device 105 is configured for separating the stack 101 from the lower stack 119 by lifting and pushing the stack 101 from the stacking section 102 to the delivery ramp 103. Specifically, the feeder device 105 comprises a lifting platform 106 which is configured for lifting the flat elements defining the stack 101. The lifting platform 106 defines a platform which comprises a sufficiently large supporting surface on which at least the edge portion 111 of the stack 101 may be arranged. Hence, by the lifting of the lifting platform 106, the edge portion 111 of the stack 101 is lifted such that at least the edge portion 111 and also a part of an adjacent center section 116 of the stack 101 is lifted from the lower stack 119. A further edge portion 115 of the stack 101 which is located at an opposite side of the stack 101 in comparison to the lifted edge portion 111 is still arranged on the topmost flat element of the lower stack 119.

This has the technical effect that the frictional contact between the lowermost flat element of the stack 101 and the topmost flat element of the lower stack 119 is reduced, making sliding of the stack 101 with respect to the lower stack 119 is easier. In particular, the lifting platform 106 is formed and arranged generally within a horizontal plane, such that the weight of the stack 101 may be transferred to the lifting platform 106.

Furthermore, the feeder device 105 comprises the pushing platform 107 which is configured for pushing the stack 101 along a linear path 108 from the stacking section 102 to the receiving surface 104. The pushing platform 107 is sufficiently large that the stack 101 may be pushed along the linear path 108 without damaging the flat elements of the stack 101. In particular, the pushing platform 107 is formed generally within a vertical plane such that a pushing force is exertable along a horizontal direction by moving the pushing platform 107 along the linear path 108. In particular, the pushing platform 107 is configured such that the pushing platform 107 may be guided against a lateral surface of the stack 101. In particular, the pushing platform 107 is formed such that the pushing platform 107 pushes, in particular against the lowermost flat element of the stack 101. However, the pushing platform 107 may extend from the lowermost flat element of the stack 101 to the topmost flat element of the stack 101 such that a proper transfer of the pushing force to the stack 101 is provided.

The lifting platform 106 and the pushing platform 107 are formed integrally and hence may be moved together such that no relative movement between the lifting platform 106 and the pushing platform 107 is possible.

The stack 101 is movable along the linear path 108. Furthermore, the feeder device 105 is movable specifically along the linear path 108.

The feeder device 105 may be coupled to a feeder guiding system 120, which comprises, for example, a supporting framework. Along the supporting framework, the feeder device 105 may be driven automatically or manually in a remote controlled manner.

Furthermore, a position of the delivery ramp 103 is adjustable along the vertical direction. Hence, the height of the delivery ramp 103 from the bottom is adjustable. Hence, also the height of the receiving surface 104 is adjustable in its height, so that the height and hence the amount of flat elements in the stack 101 is adjustable by adjusting the height of the receiving surface 104. The higher the receiving surface 104, the smaller the height and the lower the amount of flat elements of the stack 101 is adjustable. The lower the receiving surface 104, the taller the height and the greater is the amount of flat elements of the stack 101 and these are adjustable.

The receiving surface 104 is formed such that the stack 101 may be arranged on it by the feeder device 105, wherein (at least a section of) the receiving surface 104 is formed within a plane which normally comprises a component parallel to the horizontal direction such that the stack 101 is slidable along the receiving surface 104 by force of gravity. The receiving surface 104 or at least a part of the receiving surface 104 is formed like a ramp having an inclination such that the stack 101 slides due to gravity forces along the receiving surface 104 to a desired final destination. Hence, no further pushing mechanism along the receiving surface 104 may be necessary.

In order to improve the sliding of the stack 101 along the receiving surface 104, a vibration system may be arranged to the receiving surface 104 of the delivery ramp 103, such that the receiving surface 104 vibrates. Vibration of the receiving surface 104, supports sliding of the stack 101 along the receiving surface 104.

Figure 2:
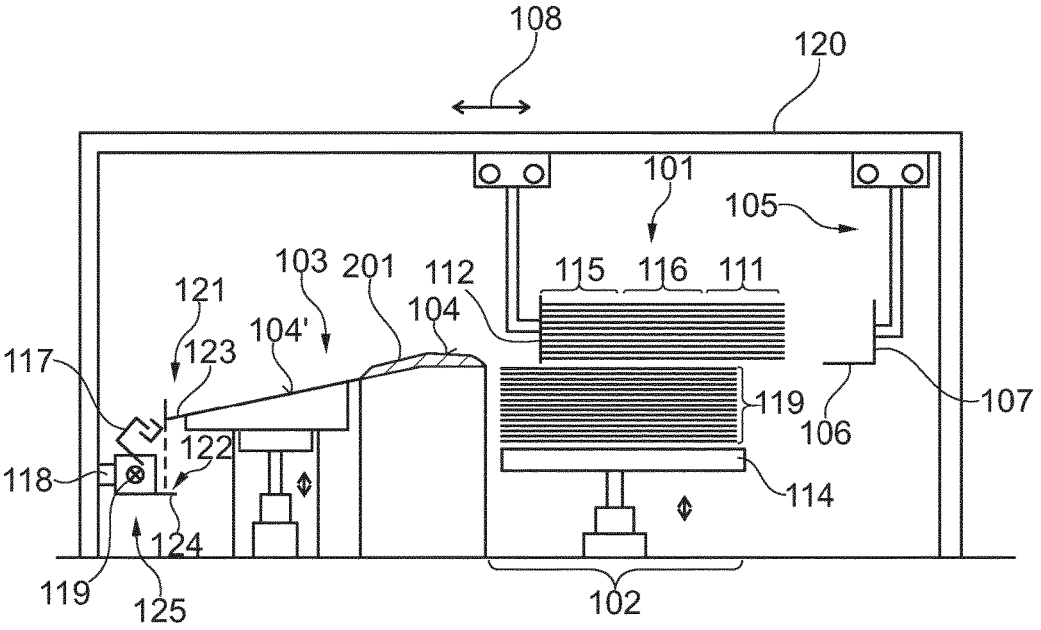

As shown in exemplary FIG. 2, the delivery ramp 103 comprises a sliding rail 201 arranged on the receiving surface 104. The stack 101 is slideable along the sliding rail 201. The sliding rail 201 is configured such that the stack 101 may be pushed on the sliding rail 201 by the pushing platform 107. The sliding rail 201 is a protrusion on or above the receiving surface 104. The sliding rail 201 extends from an edge of the sliding surface adjacent to the stacking section 102 along the linear path 108 to a section of the receiving surface 104 which defines a desired final destination of the stack 101. By arranging the stack 101 on the sliding rail 201, the size of the contact region of the stack 101 with respect to the receiving surface 104 is reduced so that also the friction between the stack 101 and the receiving surface 104 is reduced which promotes the sliding of the stack 101 along the receiving section.

The stacking section 102 comprises a stacking platform 114 on which the flat elements are stackable. The stacking platform 114 is liftable along a vertical direction (i.e. the lifting direction 110).

Hence, the height of the stacking platform 114 from the bottom is adjustable. Also the height difference with respect to the receiving surface 104 is adjustable, so that the height and hence the amount of flat elements in the stack 101 is adjustable by adjusting the height of the stacking platform 114. The smaller is the height distance between the stacking platform 114 and the receiving surface 104, the taller is the height of the stack 101 to be portioned and the higher is the amount of flat elements of the stack 101. The taller is the height distance between the stacking platform 114 and the receiving surface 104, the shorter is the height of the stack 101 to be portioned and the lower is the amount of flat elements of the stack 101

Before the step of moving a lifting platform 106 of the feeder device 105 partially below the flat elements defining the stack 101, a further pushing platform 112 is moved along the linear path 108 against a leading lateral face 113 of the stack 101 such that the stack 101 is pushed along the linear path 108 in the direction toward the feeder device 105 such that the edge portion 111 of the stack 101 projects from the lower stack 119 along the linear path 108 and is arrangeable on the lifting platform 106. Hence, it is easier to move the lifting platform 106 below the edge portion 111 of the stack because the edge portion 111 extends rearwardly from the lower stack 119. In particular, the further pushing platform 112 is formed such that the further pushing platform 107 is pushing against the lowermost flat element of the stack 101. However, the further pushing platform 903 (FIG. 9) may extend from the lowermost flat element of the stack 101 to the topmost flat element of the stack 101 such that a proper transfer of the pushing force to the stack 101 is provided.

FIG. 1 to FIG. 6, show a transfer system for transferring the stack 101 to a processing device. The transfer system comprises a first comb structure 121 mounted to the delivery ramp 103 and comprising at least one first supporting platform 123 on which at least the further edge portion 115 of the stack 101 is supportable.

The transfer system further comprises a second comb structure 122 comprising at least one second supporting platform 124 on which at least the further edge portion 115 of the stack 101 is supportable, wherein the second comb structure 122 is configured for supplying the stack 101 to the processing device. The first supporting platform 123 and the second supporting platform 124 are interleaved with respect to each other such that the further edge portion 115 of the stack is supportable on both the first supporting platform 123 and the second supporting platform 124. The first comb structure 121 and the second comb structure 122 are movable with respect to each other such that the further edge portion 115 of the stack 101 is supportable at least by one of the first supporting platform 123 and the second supporting platform 124.

The first and the second supporting platform 123, 124 are configured for supporting the flat elements defining the stack 101. Each of the first and the second supporting platforms 123, 124 defines a platform which comprises a sufficiently large supporting surface, on which at least the further edge portion 115 of the stack 101 may be arranged.

The first supporting platform 123 and the second supporting platform 124 are interleaved with each other which means that the first supporting platform 123 and the second supporting platform 124 are arranged along a first direction 109 one after another. The first supporting platform 123 and the second supporting platform 124 comprise respective lateral edges which are arranged adjacent to each other along the first direction 109. The first direction 109 describes for example a direction which is parallel to an edge of the delivery ramp 103 and hence parallel to the further edge portion 115 of the stack 101 which is located on the delivery ramp 103.

The first supporting platform 123 is mounted to the delivery ramp 103. Hence, the edge of the stack 101 located on the receiving surface 104' may be supported by the first supporting platform 123. The second supporting platform 124 is mounted to a mounting structure, such as a mounting bar. The mounting structure and the delivery ramp 103 may be arranged spaced apart from each other, wherein the first supporting platform 123 extends from the delivery ramp 103 to the mounting structure and the second supporting platform 124 extends from the mounting structure to the delivery ramp 103. Hence, the further edge portion 115 of the stack 101 is arranged in the gap 705 (see FIG. 7) between the mounting structure and the delivery ramp 103 (see FIG. 6). Within the gap 705, the first supporting platform 123 and the second supporting platform 124 are arranged along the first direction 109, wherein dependent on the height of the delivery ramp 103 for the mounting structure, the first or the second support porting platform supports the further edge portion 115.

The first supporting platform 123 is movable (in particular along a vertical direction) with respect to the second supporting platform 124 in such a way, that if the edge of the stack 101 is supported by the first supporting platform 123, the second supporting platform 124 may be moved against the further edge portion 115 to lift the further edge portion 115 of the stack 101 away from the first supporting platform 123. Hence, the further edge portion 115 of the stack 101 is arranged on and is supported by the second supporting platform 124. Alternatively, the first supporting platform 123 may be lowered (i.e. along the vertical direction), e.g. by lowering the delivery ramp 103, such that the edge of the stack 101 is supported by the second supporting platform 124 if the first supporting platform 123 is moved lower than the second supporting platform 124.

Hence, the stack 101 is supported by the first system, i.e. the delivery ramp 103, and is transferred to a second system, e.g. the transfer system, in a robust and simple manner. If the further edge portion 115 of the stack 101 is supported by the second supporting platform 124, the second comb structure may be moved together with the stack 101 to a further processing process, for example.

Figure 7:
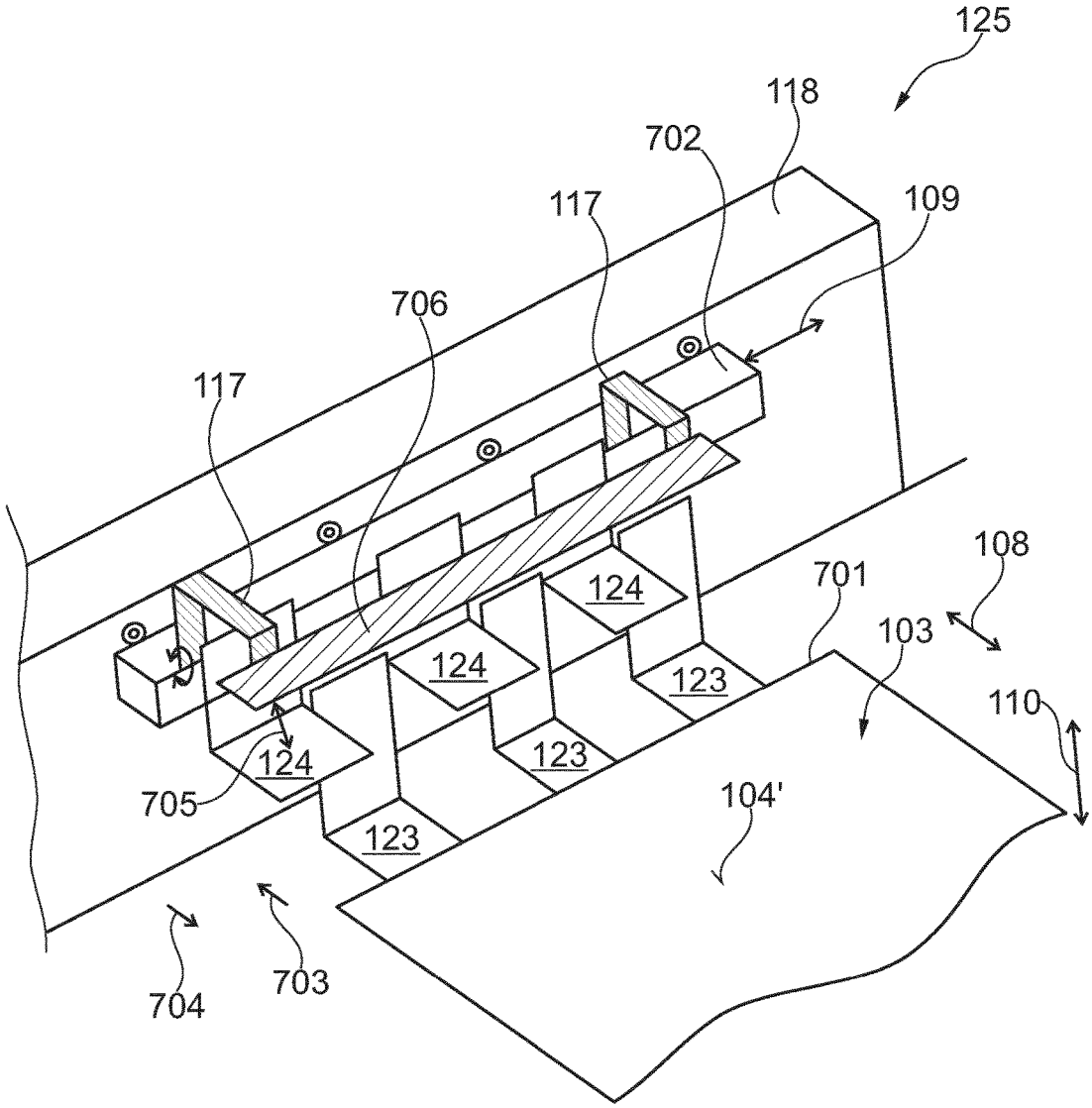
FIG. 7 shows a perspective view of a transfer system according to an exemplary embodiment of the present invention.

The transfer system is described more in detail in FIG. 7.

Furthermore, as shown in FIG. 1 to FIG. 6, a feeder system for feeding the stack 101 to the processing device is illustrated. The feeder system comprises a transport device 125 comprising the at least one second supporting platform 124 as described above. The second supporting platform 124 is arranged adjacent to the receiving surface 104' such that the further edge portion 115 of the stack 101 is receivable (see FIG. 6).

Figure 6:
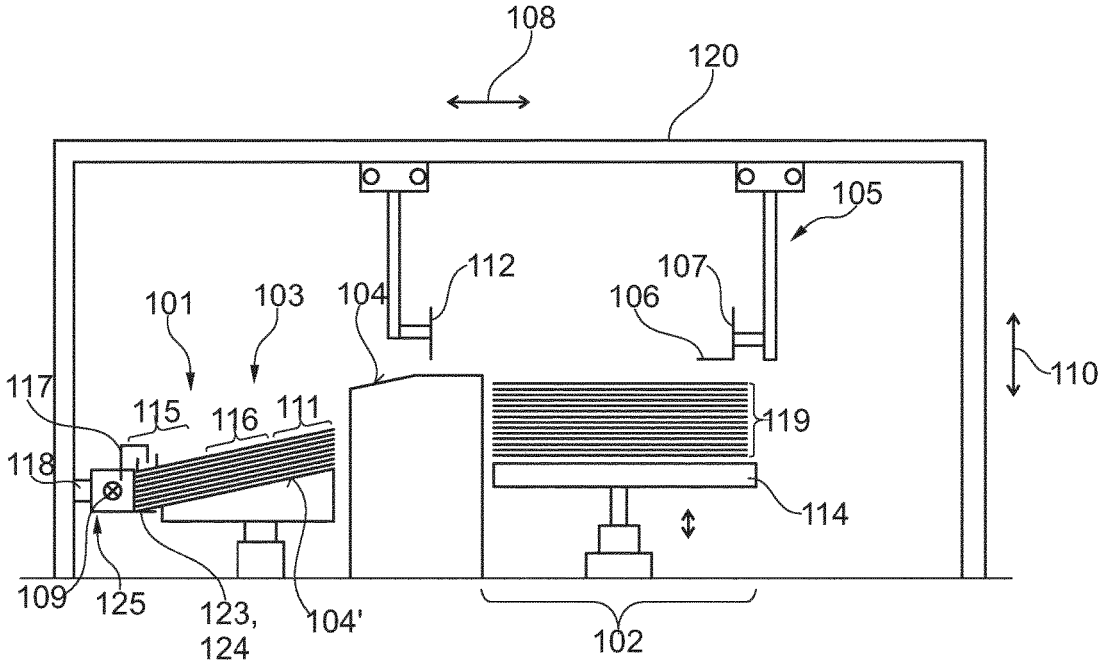

The feeder system further comprises a downholder element 117, wherein the downholder element 117 is configured for adjusting a size of a gap 705 between the downholder element 117 itself and the second supporting platform 124 such that the further edge portion 115 of the stack 101 is clampable between the downholder element 117 and the supporting platform (see FIG. 6). The transport device 125 is configured to be movable between a receiving position and a hand over position at the processing device such that the stack 101 is movable from the receiving position to the hand over position.

Hence, by the above described transport system, the further edge portion 115 of the stack 101 is clamped by the downholder element 117 to the second supporting platform 124. The rest of the stack 101 which is not clamped by the downholder element 117 is arranged on the receiving surface 104' of the delivery ramp 103, for example. By moving the transport device 125 along a desired moving direction, e.g. transversely to the prior movement over the surface 104, for example the first direction 109, the stack 101 of flat elements slips away from the receiving surface 104' to the desired location, such as the hand over position.

The transport device 125 comprises a transport carriage to which the second supporting platform 124 is coupled. The transport carriage is coupled to a transverse guiding rail 118 such that the transport carriage is drivable along the guiding rail 118 to the hand over position.

In the following, the method for portioning and transferring the stack 101 from the stacking section 102 to the transfer system 125 is summarized following:

In an initial position, the flat elements are arranged in the stacking section 102. Next, the further pushing platform 112 pushes against the further edge portion 115 and pushes the stack 101 rearwardly along the linear path 108 until the edge portion 111 projects from the lower stack 119 (see FIG. 2).

Figure 3:
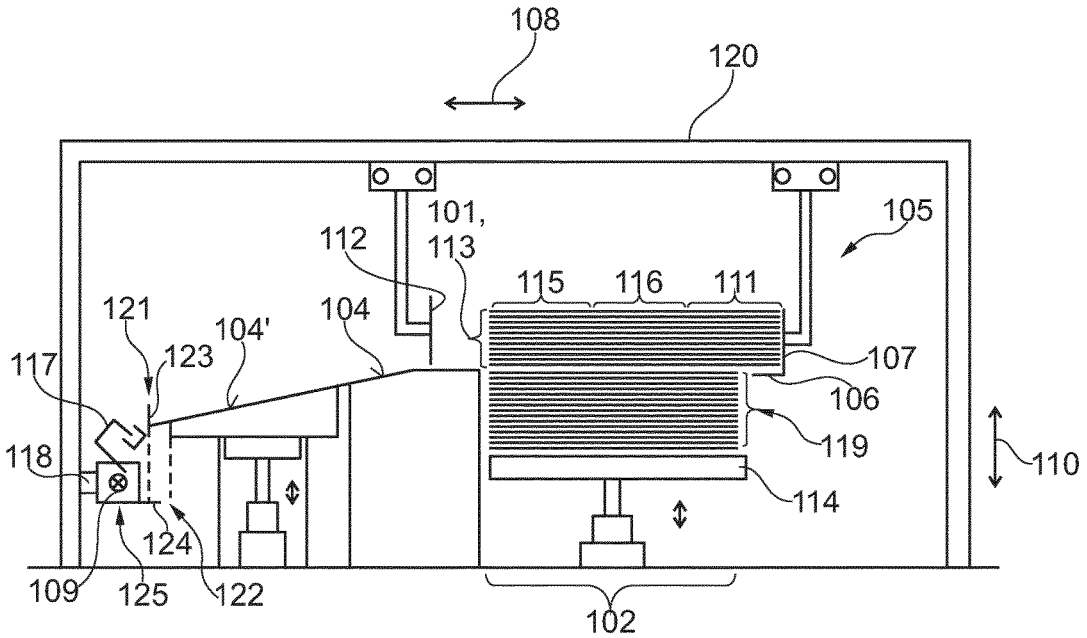

Next, the feeder device 105 is moved in a position, where the lifting platform 106 is arranged below the edge portion 111 and the pushing platform 107 contacts the trailing face of the stack 101 (FIG. 3).

Next, the feeder device 105 is moved in a position, where the lifting platform 106 lifts the edge portion 111 and partially the center section 116 of the stack 101 from the lower stack 119. Further, the pushing platform 107 pushes against the trailing lateral face of the edge portion 111 and hence pushes the stack 101 along the linear path 108 in the direction to the receiving surface 104 (see FIG. 1).

Figure 4:
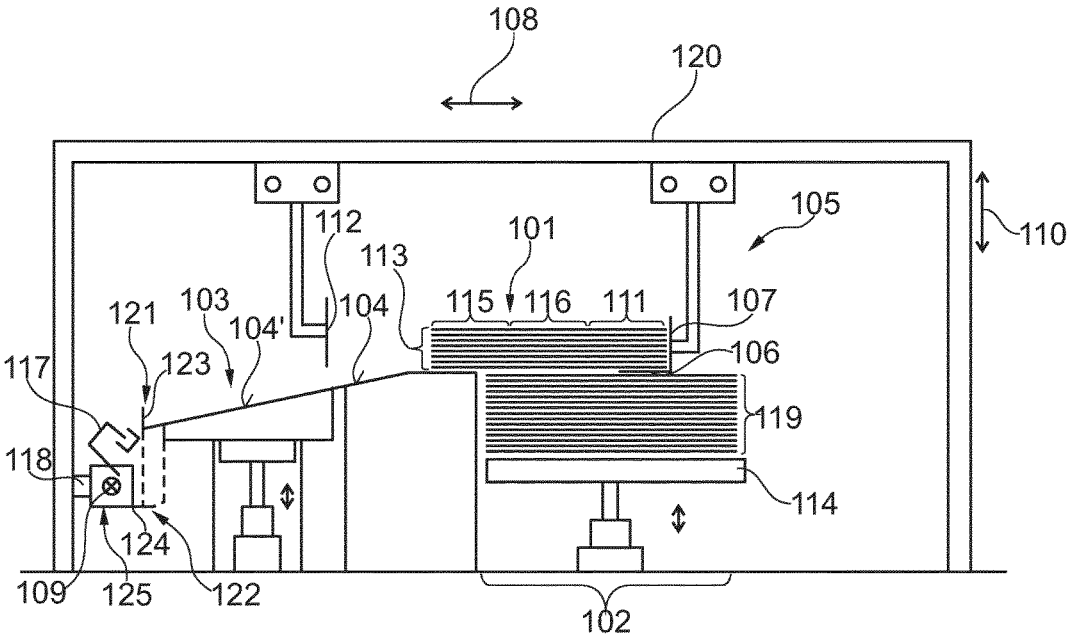
Figure 5:
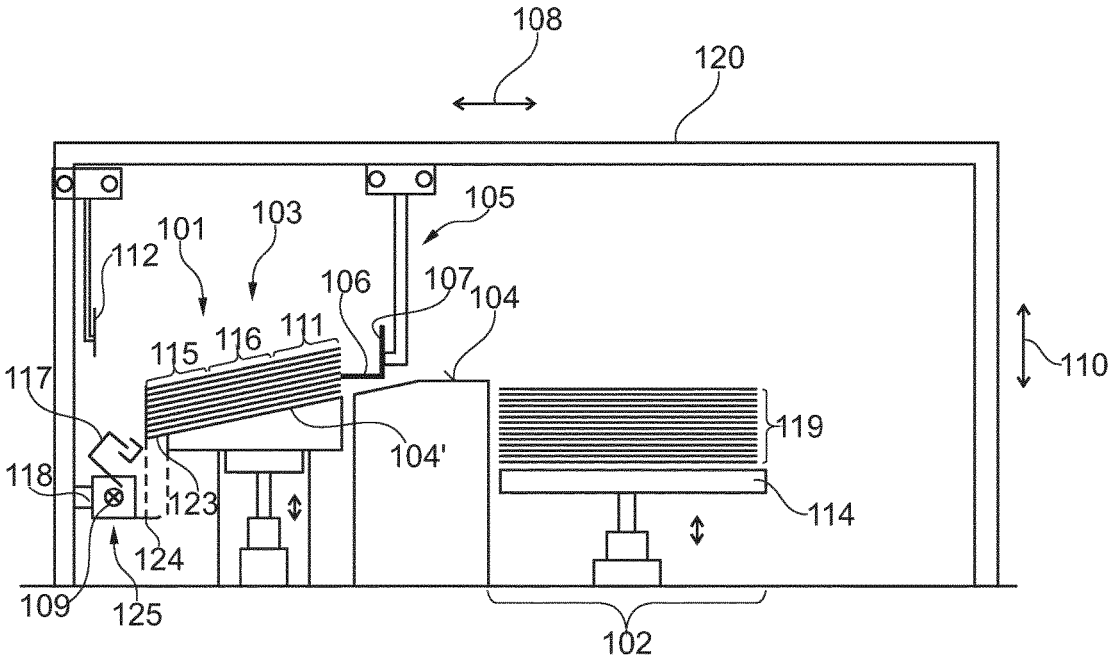

Next, the device 105 pushes the stack 101 along the linear path 108 until the stack 101 is arranged on the receiving surface 104 (see FIG. 4).

Next, the stack 101 slides along the receiving surface 104 of the delivery ramp 103 until the further edge portion 115 of the stack 101 is arranged on the first supporting platform 123 of the first comp structure 121. The receiving surface 104' may be inclined such that the stack 101 slides due to its weight and the force of gravity from the feeder device 105 along the receiving surface 104' until the stack 101 is decoupled from the feeder device 105 (see FIG. 5). The first supporting platforms 123 and the second supporting platforms 124 may comprise vertically extending platforms which functions as a stopper such that the movement of the stack 101 along the linear path 108 is limited.

Next, a portion of the receiving surface 104', on which the stack 101 is arranged, is movable along the lifting direction 110. Hence, the receiving surface 104' is lowered until the first supporting platforms 123 are lower than the second supporting platforms 124 of the second comb structure 122. In this position, the further edge portion 115 is fully supported by the second supporting platforms 124 and, completely decoupled from the first supporting platforms 123. In this position of the stack 101, the downholder element 107 clamps the further edge portion 115 against the second supporting platforms 124, such that the stack 101 is movable, for example transversely along the first direction 109 (see FIG. 6).

In this position shown in FIG. 6, the stack 101 is portioned such that the stack 101 comprises the desired amount of flat elements and hence has a desired height. Furthermore, the stack 101 is transferred from the portioning system to the feeder system by the transfer system. Next, as described further below, the feeder system may move the clamped stack 101 along the first direction 109 from the receiving surface 104' to the hand over position.

Hence, by the portioning system according to the present invention, the feeder device 105 is driven in the lifting position, where the lifting platform 106 is moved between a lowermost flat element of the stack 101 and a topmost flat element of the lower stack 119. Next, the feeder device 105 lifts the lifting platform 106 along a lifting direction 110 such that the edge portion 111 and for example a further part of the center portion 116 of the stack is lifted and hence separated from the topmost flat element of the lower stack. Next, the pushing platform 107 of the feeder device 105 pushes the stack from the lower stack at the stacking section 102 above the receiving surface 104 of the delivery ramp 103.

FIG. 7 shows a more detailed view of the transfer system for transferring the stack 101 to the processing device and the feeder system for feeding the stack to the processing device.

The first comb structure 121 comprises a first mounting bar 701 extending along the first direction 109, wherein the first supporting platforms 123 are mounted to the first mounting bar 701 (which may be part of the delivery ramp 103) and extend from the first mounting bar 701 along a second direction 703, which is perpendicular to the first direction 109. The second comb structure 122 comprises a second mounting bar 702 extending along the first direction 109, wherein the second mounting bar 702 is spaced apart from the first mounting bar 701 along the second direction 703. The second supporting platforms 124 are mounted to the second mounting bar 702 and extend from the second mounting bar 702 along a third direction 704, which is antiparallel to the second direction 703.

Two first supporting platforms 123 are spaced apart from each other (i.e. along the first direction 109) such that a respective one of the second supporting platforms 124 is movable through the space between the two first supporting platforms 123. Hence, along the first direction 109, the first supporting platforms 123 and the second supporting platforms 124 are arranged in an alternating manner.

The first comb structure 121 is movably supported e.g. by the delivery ramp 103 in such a way that the first comb structure 121 is movable along the lifting direction 110 with respect to the second comb structure 122 such that the first supporting platforms 123 pass the second supporting platforms along the lifting direction 110.

The downholder element 117 is a clamping bar 706 extending along the further edge portion 115 of the stack 101.

The downholder element 117 may be for example hinged to the second mounting bar 702. Hence, the downholder element 170 is pivotable between a clamping position, where the clamping bar 706 clamps the further edge portion 115 of the stack 101 against the second supporting platforms 124 and a releasing position, where the clamping bar 706 does not clamp the stack 101 to the second supporting platforms 124.

The second mounting bar 702 may be movably mounted to a guiding rail 118 such that the second mounting bar 702 is movable together with the clamped stack 101 along the first transverse direction 109.

Figure 8:
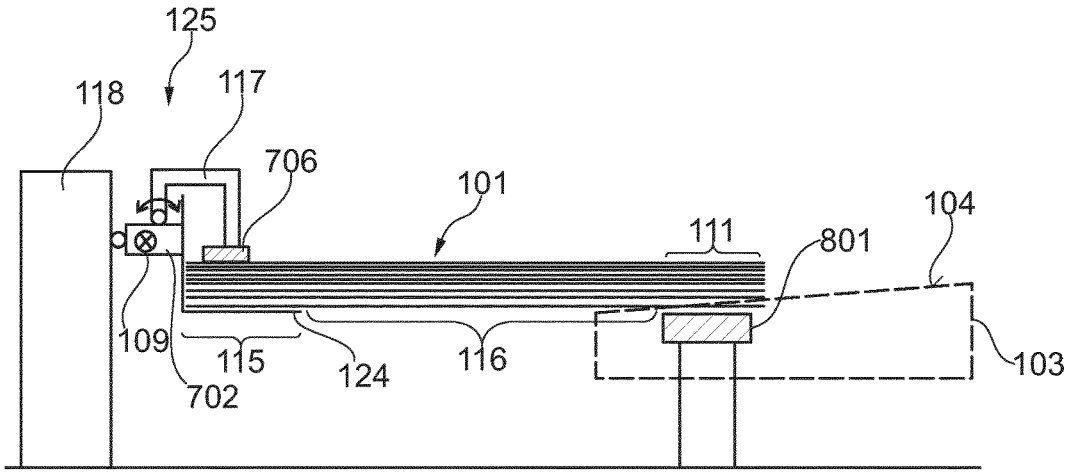
FIG. 8 shows a schematic view of a transfer system according to an exemplary embodiment of the present invention.

FIG. 8 shows a schematic view of the feeder device, wherein the clamping bar 706 is shown in the clamping position and hence clamps the further edge portion 115 of the stack 101 against the second supporting platforms 124. The second mounting bar 702 and the stack 101 as shown in FIG. 8 are moved along the first direction 109 in comparison to the position as shown in FIG. 7. Hence, the delivery ramp 103 is already located in the back of the stack 101 and is hence illustrated in dotted lines. Hence, the center portion 116 and the edge portion 111 of the stack 101 already left the receiving surface 104.

A carrier element 801 is arranged between the delivery ramp 103 and the hand over position, wherein the carrier element 801 is further arranged such that a portion of the stack 101 being arranged on the receiving surface 104' is receivable by the carrier element 801. The carrier element 801 is configured to carry the portion of the stack 101 between the delivery ramp 103 and the hand over position. The carrier element 801 is fixed to a ground, wherein the carrier element 801 comprises a sliding surface extending between the delivery ramp 103 and the hand over position. The sliding surface is formed such that the stack 101 is slideable on the sliding surface between the delivery ramp 103 and the hand over position.

The carrier element 801 is for example a table or a supporting bar which extends along a desired direction, in particular along the first direction 109. The carrier element 801 is in the same height or a little bit lower with respect to the receiving surface 104 (shown in dotted lines), such that the portion of the stack 101 which surrounds the edge which is clamped by the downholder element 117 may slip from the receiving surface 104 on the carrier element 801. Hence, a smoother more soft transport of the stack 101 is provided.

Figure 9:
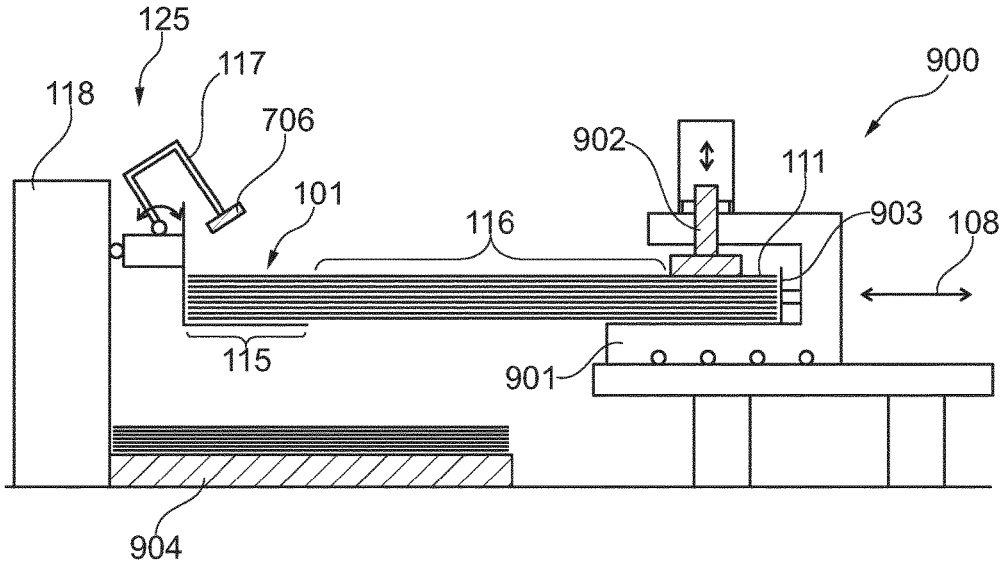
FIG. 9 shows a schematic view of a transfer system and a hand over system according to an exemplary embodiment of the present invention.

FIG. 9 shows the feeder device and the hand over position. A hand over device 900 is arranged at the hand over position. The hand over device 900 comprises a hand over platform 901, wherein the hand over platform 901 is formed such that at the hand over position the stack 101 is feedable to the processing device. The hand over device 900 comprises a further downholder element 902, wherein the further downholder element 902 is arranged for adjusting a size of a further gap between the further downholder element 902 itself and the hand over platform 901 such that the edge portion 111 of the stack 101 is clampable between the further downholder element 902 and the hand over platform 901.

If the second supporting platforms 124 are driven to the hand over position, the edge portion 111 of the stack 101 is arranged on the hand over platform 901. Next, the further downholder element 902 clamps the edge portion 111 against the hand over platform 901. In a next step, the downholder element 117 may release the further edge portion 115 of the stack 101 and the transport device 125 may drive back to the receiving position, where a new further stack 101 may be received. Next, the further downholder element 902 may release the edge portion 111 of the stack 101 and the flat elements forming the stack 101 may be processed in the processing device.

Additionally, the hand over device 900 is movable e.g. along the linear path such that a distance between the second supporting platform 124 and the hand over platform 901 is variable so that the hand over platform 901 is movable away from the second supporting platform 124 for pulling the further edge portion 115 of the stack 101 from the second supporting platforms 124 if the further downholder element 902 clamps the edge portion 111 to the hand over platform 901.

Hence, the further edge portion 115 of the stack 101 lays on a feeding platform 904, whereas the edge portion 111 is still clamped by the further downholder element 902. In a next step, the hand over platform 901 is moved along the linear path 108 again in a direction to the second supporting platforms 124 until the further edge portion 115 and hence the stack 101 are arranged in a desired final position on the feeding platform 904. In a final step, the further downholder element 902 releases the edge portion 111 and the hand over platform 901 moves again away from the second supporting platforms 124 such that the further edge portion 115 slips down from the hand over platform 901. Finally, the stack 101 comprising a desired amount of flat elements is arranged at the feeding platform 904 from which the flat elements may be fed to the processing device.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A portioning system for portioning stackable flat elements, in a stack, wherein the portioning system comprises:

a stacking section on which flat elements are stackable;

a delivery position adjacent to the stacking section so that the stack is pushable from the stacking section to the delivery position;

a feeder device comprising a lifting platform and a pushing platform, a linear path along which the feeder device is movable for pushing the stack to the delivery position;

the feeder device is movable along a lifting direction having at least a component parallel to a direction of the force of the gravity;

the feeder device is located and configured and operable such that the lifting platform is movable partially below the flat elements defining the stack and such that an edge portion of the stack is arranged on the lifting platform for being liftable by the lifting platform;

the feeder device is further located and configured such that the stack is pushable by the pushing platform along the linear path until the stack is arranged at the delivery position;

a further pushing platform configured to be moved along the linear path, the further pushing platform is located and configured for being moved against a lateral face of the stack that is transverse to the linear path, such that the stack is pushed along the linear path in a direction of the feeder device such that the edge portion of the stack is arrangeable on the lifting platform; and a delivery ramp comprising a receiving surface forming a delivery position for receiving the stack, the delivery ramp is arranged adjacent to the stacking section such that the stack is pushable from the stacking section to the delivery ramp.

2. The portioning system according to claim 1, wherein the feeder device is configured such that an angle between the lifting platform and the pushing platform is between 90° and 130°.

3. The portioning system according to claim 1, wherein a position of the delivery ramp is adjustable along a vertical direction.

4. The portioning system according to claim 3, wherein the delivery ramp comprises a sliding rail arranged on the receiving surface, configured such that the stack is slideable along the sliding rail, and wherein the sliding rail is formed such that the stack is pushable on the sliding rail by the pushing platform.

5. The portioning system according to claim 1, wherein the receiving surface is located and configured such that the stack is arrangeable on the receiving surface by the feeder device;

the receiving surface is formed within a plane which comprises a component parallel to a horizontal direction such that the stack is slidable along the receiving surface due to gravity.

6. The portioning system according to claim 5, further comprising:

a vibration system coupled to the receiving surface of the delivery ramp such that the receiving surface vibrates.

7. The portioning system according to claim 1, wherein the stacking section comprises a stacking platform on which the flat elements are stackable, and wherein the stacking platform is liftable along a vertical direction.

8. The handling system according to claim 1, further comprising:

a feeder system for feeding the stack to a processing device, the feeder system comprising:

a transport device comprising at least one second supporting platform, wherein the at least one second supporting platform is adjacent to the delivery position such that a further edge portion of the stack is received on the second supporting platform;

a downholder element configured and arranged for adjusting a size of a gap between the downholder element and the second supporting platform, such that the further edge portion of the stack is clampable between the downholder element and the second supporting platform; and the transport device is configured to be movable between a receiving position and a hand over position at the processing device such that the stack is movable from the receiving position to the hand over position.

9. The handling system according to claim 8, further comprising:

a carrier element which is arranged between the delivery position and the hand over position, and such that a portion of the stack is arranged at the delivery position and is receivable by the carrier element; and wherein the carrier element is configured to carry the portion of the stack between the delivery position and the hand over position.

10. A handling system configured to handle a stack of stackable flat elements comprising the portioning system according to claim 1, and further comprising:

a transfer system configured for transferring the stack to a processing device, the transfer system comprising:

a first comb structure comprising at least one first supporting platform on which configured to support at least a further edge portion of the stack, wherein the first comb structure is arranged at the delivery position;

a second comb structure comprising at least one second supporting platform on which configured to support at least the further edge portion of the stack, and the second comb structure is configured for supplying the stack to the processing device; and the first supporting platform and the second supporting platform are arranged along a first direction one after another in an interleaved manner such that the further edge portion is supportable on the first supporting platform and on the second supporting platform, wherein the first comb structure and the second comb structure are movable along the lifting direction with respect to each other such that the further edge portion of the stack is supportable selectively by the first supporting platform or by the second supporting platform.

11. The handling system according to claim 10, further comprising:

the first comb structure comprises a first mounting bar extending along the first direction;

the at least one first supporting platform is mounted to the first mounting bar and extends from the first mounting bar along a second direction, which is perpendicular to the first direction;

the second comb structure comprises a second mounting bar extending along the first direction, the second mounting bar is spaced apart from the first mounting bar along the second direction; and the at least one second supporting platform is mounted to the second mounting bar and extends from the second mounting bar along a third direction, which is opposite to the second direction.

12. A method for portioning stackable flat elements in a stack for further processing, the method comprising:

stacking flat elements on a stacking section;

moving a lifting platform of a feeder device partially below the flat elements defining the stack such that an edge portion of the stack is arranged on the lifting platform;

lifting the lifting platform along a lifting direction having at least a component parallel to a direction of the force of gravity;

pushing the stack by a pushing platform of the feeder device along a linear path until the stack is arranged at a delivery position and;

before the step of moving the lifting platform of the feeder device partially below the flat elements defining the stack, moving a further pushing platform along the linear path against a lateral face of the stack which is transverse to the linear path such that the stack is pushed along the linear path in a direction of the feeder device such that the edge portion of the stack is arrangeable on the lifting platform, wherein the stack is pushable to a delivery ramp having a receiving surface forming the delivery position for receiving the stack.

* * * * *